US005552021A

United States Patent [19]

Ilvespää et al.

[11] Patent Number: 5,552,021

[45] Date of Patent: Sep. 3, 1996

[54] METHOD, DEVICE AND ARRANGEMENT FOR REGULATING THE CONTROL OF A TRANSVERSE PROFILE OF A PAPER WEB IN A PAPER MACHINE

[75] Inventors: Heikki Ilvespää, Jyväskylä; Jyrki Jaakkola, Korpilahti; Ari Linsuri, Jyväskylä; Erkki Partanen, Jyväskylä; Antti Poikolainen, Jyväskylä; Pasi Turpeinen, Jyväskylä; Lauri Verkasalo, Jyväskylä, all of Finland

[73] Assignee: Valmet Corporation, Helsinki, Finland

[21] Appl. No.: 262,138

[22] Filed: Jun. 17, 1994

[30] Foreign Application Priority Data

| | | | |
|---|---|---|---|
| Jun. 17, 1993 | [FI] | Finland | 932793 |
| May 3, 1994 | [FI] | Finland | 942027 |

[51] Int. Cl.[6] ..... D21F 1/00

[52] U.S. Cl. ..... 162/203; 162/198; 162/252; 162/263; 162/301; 162/259

[58] Field of Search ..... 162/252, 258, 162/259, 300, 301, 352, 198, 203, 263

[56] References Cited

U.S. PATENT DOCUMENTS

| | | | |
|---|---|---|---|
| 4,342,619 | 8/1982 | Gladh | 162/262 |
| 4,687,548 | 8/1987 | Ilmoniemi et al. | 162/216 |
| 4,769,111 | 9/1988 | Nevalainen et al. | 162/351 |
| 4,874,467 | 10/1989 | Karlsson et al. | 162/198 |
| 4,875,977 | 10/1989 | Creagan et al. | 162/352 |
| 4,897,158 | 1/1990 | Weisshuhn et al. | 162/259 |
| 4,988,408 | 1/1991 | Evalahti | 162/352 |
| 5,078,835 | 1/1992 | Schiel et al. | 162/352 |
| 5,211,814 | 5/1993 | Jaakkula et al. | 162/352 |
| 5,215,628 | 6/1993 | Koivuranta | 162/301 |

FOREIGN PATENT DOCUMENTS

| | | | |
|---|---|---|---|
| 2106355 | 3/1994 | Canada | 162/301 |
| 0306759 | 3/1989 | European Pat. Off. . | |
| 0371786 | 6/1990 | European Pat. Off. . | |
| 0372815 | 6/1990 | European Pat. Off. . | |
| 0516601 | 12/1992 | European Pat. Off. . | |
| 913112 | of 0000 | Finland . | |
| 911281 | of 0000 | Finland . | |
| 920228 | of 0000 | Finland . | |
| 62566 | 8/1979 | Finland . | |
| 86207 | 12/1981 | Finland . | |
| 824439 | 6/1984 | Finland . | |
| 834334 | 5/1985 | Finland . | |
| 885607 | 12/1988 | Finland . | |
| 885609 | 12/1988 | Finland . | |
| 9212448 | 12/1992 | Germany | 162/301 |
| 1225517 | 3/1971 | United Kingdom . | |
| 87/06633 | 11/1987 | WIPO | 162/352 |

*Primary Examiner*—Karen M. Hastings

*Attorney, Agent, or Firm*—Steinberg, Raskin & Davidson P.C.

[57] ABSTRACT

A method, device, and arrangement in a paper machine for regulating the control of the transverse profile or profiles of properties of a paper web produced therein. Water is removed from the paper web under compression between two forming wires by making use of dewatering and/or forming ribs. The deflection of the dewatering and/or forming ribs in the transverse direction of the web is regulated thereby affecting the retention profile of the paper web in the cross direction. By regulating the deflection of the dewatering and/or forming ribs, the transverse fiber-orientation profile and/or the filler profile of the paper web is influenced through the control of the transverse retention profile of the web.

27 Claims, 7 Drawing Sheets

METHOD, DEVICE AND ARRANGEMENT FOR REGULATING THE CONTROL OF A TRANSVERSE PROFILE OF A PAPER WEB IN A PAPER MACHINE

BACKGROUND OF THE INVENTION

The present invention relates to a method in a paper machine for controlling the transverse profile of at least one property of a paper web in which water is removed from the paper web under compression between two forming wires by dewatering and/or forming ribs.

The invention also relates to a device in a paper machine for controlling the transverse profile of at least one property of the paper web which comprises an MB former including a twin-wire zone and an MB unit placed in the zone. In the MB unit, there are two sets of dewatering and/or forming ribs which operate one against the other. At least one of the sets of ribs can be loaded by means of the pressure of a pressure medium against the opposite set of ribs.

Further, the invention relates to an arrangement in a paper machine for regulating the control of the transverse profile of at least one property of the paper web that is being produced in the paper machine. The paper machine comprises a wire part including a twin-wire zone having sets of ribs placed one opposite to the other and operatively pressing against each other. The regulation arrangement includes an arrangement for measuring the grammage profile of the paper web which is placed in connection with, or after, the dryer section of the paper machine and which gives a measurement signal to the process control unit. The process control unit gives a regulation signal to the profiling devices for profiling the profile bar of the slice of the headbox in the paper machine.

In the prior art, the headbox of a paper machine includes a discharge duct which is typically defined from below by a stationary, lower-lip beam and from the opposite side by an upper-lip beam. The upper-lip beam is pivotally fixed in connection with the upper-lip constructions by means of a horizontal articulated joint. At the front edge of the upper-lip beam, there is a profile bar which determines the exact profile of the slice in the transverse direction of the machine. In a manner in itself known, the profile bar includes regulation devices by whose means the profile of the slice is fine-adjusted or "fine tuned". As is known from the prior art, the upper-lip beam is supported from above by means of a number of support arms, typically between 4 and 6. Attempts have been made to arrange this suspension such that the deflection of the upper-lip beam is as small as possible, and the fine adjustment of the profile of the slice has usually been arranged by means of the adjustable profile bar.

In the prior art, headboxes are also known in which the upper-lip beam is supported by means of arms from both of its ends. In addition to the arms, various support and crown-variation arrangements have been used for supporting the headbox, e.g., devices operating by means of hydraulic pressure chambers or hoses.

Attempts have been made to construct the prior art headboxes so that it should be possible to produce a paper homogeneous in respect of its grammage, formation, and strength properties across the entire web width so that a minimum proportion has to be cut off at the edges of the web. In view of achieving these objectives, it is known from the prior art to employ various additional flows or exhaust flows in connection with each side wall at both sides of the discharge duct of the headbox, with respect to which flows reference is made to the assignee's Finnish Patent No. 75,377 (corresponding to the assignee's U.S. Pat. No. 4,687,548, the specification of which is incorporated by reference herein).

It is a particularly important requirement, in particular in the case when producing fine paper, that the principal axes of the directional distribution, i.e., the orientation, in the fiber mesh of the paper coincide with the directions of the main axes of the paper and that the orientation is symmetric in relation to these axes. For example, in the case of copying paper, it is important that the orientations in the upper face and in the lower face of the paper are substantially equal. It is frequently not possible to meet the above requirements sufficiently precisely across the entire width of the web by means of the prior art devices referred to above. Factors that are particularly difficult and that have resulted in complaints have been diagonal curling of a sheet and "tilting" of a pile of forms.

The problems mentioned above have been studied thoroughly by the applicants and assignee. In these studies, it has been possible to establish that the symmetry required from the fiber orientation requires that a transverse velocity of about 1 cm per second to about 3 cm per second is not exceeded at any point of the finished web depending on the jet/wire velocity ratio that is used in the discharge jet. At a velocity higher than this in connection with the web draining process, the main orientation of the fibers is turned so that it diverges by about 5° to about 20° from the machine direction, thereby producing the "tilting" and curling problems. Since a transverse velocity is already produced in the discharge duct along with the attenuation of an uneven main flow profile, principal attention must be directed at the uniformity of the profile of the velocity in the flow direction after the turbulence generator.

One systematic reason for a transverse velocity in the discharge duct is the effect of slowing down the flow in the machine direction by the friction produced by the vertical side walls in the discharge duct. A second systematic effect is the flow or spreading of the pulp slurry in the Fourdrinier wire part in the lateral areas of the wire as a layer of a thickness of about 10 to 30 mm is evened by itself. The prior art additional feeds for the lateral flow are excellently suitable for compensating for these effects (as described in Finnish Patent No. 75,377).

In prior art headboxes, the cross-sectional shape of the discharge duct is measured as of uniform height in the transverse direction. Moreover, it is known from the prior art to operate the crown variation means of the upper-lip beam so that the height of the discharge duct in the transverse direction is as uniform as possible.

It is a known phenomenon that when the paper web is dried, it shrinks in the middle area of the web to a lower extent than in the lateral areas, the shrinkage being usually in the middle about 4% and in the lateral areas about 5% to about 6%. This shrinkage profile produces a corresponding change in the transverse grammage profile of the web so that, owing to the shrinkage, the dry grammage profile of a web whose transverse grammage profile was uniform after the press, has been changed during the drying. Thus, as a result of the change the grammage is slightly higher in both of the lateral areas of the web than in the middle area of the web.

Owing to the drying shrinkage of the web, the grammage-profile regulation automation, which is used commonly in the prior art, sets the profile bar of the headbox more open in the middle area than in the lateral areas. Moreover, since the discharge duct, in the manner known from the prior art, has a rectangular cross-sectional shape in the transverse direction, transverse flows are produced in the discharge jet from the edges toward the center because some of the pulp suspension flowing from the lateral areas of the discharge duct is forced to be shifted towards the middle area of the web. This has a detrimental effect in the profile of the directional angle of the fiber orientation as a so-called S-form. Attempts have been made to control this problem by adjusting the profile of the profile bar to be straighter. However, in such a case it has been necessary to be content with a lower uniformity of the grammage profile.

With respect to the prior art related to the present invention, reference is made additionally to U.S. Pat. No. 4,769,111 assigned to A. Ahlstrom Corporation, to the assignee's Finnish Patent Application No. 885609, and to Finnish Patent Application Nos. 885606 (corresponding to EP 0 371 786) and 885607 assigned to Valmet-Ahlstrom Inc., in which formers marketed under the trade mark "MB-Former" are described. Further, reference is made to the assignee's Finnish Patent Application Nos. 904489, 911281, 913112, and 920228 (corresponding to the assignee's U.S. Pat. No. 5,215,628, U.S. patent application Ser. Nos. 07/850,505, 07/903,603 and 08/006,372, respectively, the specifications of which are incorporated by reference herein), in which various combination concepts of the above MB-former units and of hybrid and gap formers are described.

OBJECTS AND SUMMARY OF THE INVENTION

It is an object of the present invention to provide further development of the applications of the prior art MB units in paper machines.

It is another object of the present invention to provide a method and an arrangement for regulation of a paper making process by whose means the S-form of fiber-orientation profile mentioned above or any other deviation of the profile can be aligned efficiently and by means of simple process operations and regulation arrangements.

Another object of the invention is to provide a method and an arrangement of regulation for a paper machine in which the alignment of the so-called S-form can be carried out without having to be content with inferior uniformity of the other profiles of the paper, especially of the grammage profile, at least not to a substantial extent.

It is a further object of the invention to provide a method and an arrangement for regulation which is simple and advantageous to carry into effect, so that it is possible to make extensive use of the arrangements of regulation and the formation members and their crown variation means that are already present and existing in a paper machine.

It is still another object of the invention to provide a regulation arrangement that can be favorably integrated in the process control and regulation system existing in the paper machine so that the regulation cycle required for the regulation arrangement in accordance with the invention does not interfere with, or cause instability in, the rest of the regulation system.

Even though the main emphasis in the invention is on the control of the profile of fiber orientation, it is a further object of the present invention to provide a filler profile as good as possible, in addition to a good and uniform grammage profile, in particular with paper grades that have a high content of fillers.

In view of achieving these objects stated above, others objects, and those that will come out later, in the method of the present invention, at least some of the dewatering ribs and/or forming ribs are deflected, preferably in a direction transverse to the principal direction of the ribs, and the deflection of the ribs is regulated, whereby the transverse fiber-orientation profile and/or the filler profile of the paper web is influenced through the control of the transverse retention profile of the web. In a preferred embodiment, a transverse property profile of the web is measured at some point and the deflection of the ribs is regulated based on the measurement of that profile. Also, the transverse profile of the slice of the headbox, through which a pulp flow is delivered, can be controlled relative to the transverse retention profile such that the transverse profile of the slice has a substantially equal width to thereby prevent the occurrence of a transverse pulp flow velocity.

In another preferred embodiment, the width of the slice of the headbox is measured in a middle area and in lateral areas in a transverse direction of the slice of the headbox. A first group of ribs is supported on a variation beam and a box beam is connected to the variation beam. Both the variation beam and box beam are arranged in an initial portion of the paper machine in proximity to the headbox. As such, the deflection of the first group of ribs is regulated based on the measurement of the width of the slice of the headbox. Alternatively, it is possible to measure the transverse grammage profile of the web after it has been dried, profile the pulp flow from the slice of the headbox by means of a profile bar, and then regulate the profile of the profile bar on the basis of the measurement of the transverse grammage profile of the dried web. In this manner, the ribs are deflected to lower the retention level in lateral areas of the web relative to an average retention level and to compensate for the increased grammage arising from the shrinkage higher than average in the lateral areas of the web upon drying of the web.

The device in accordance with the invention, comprises a unit of loading ribs which are loaded by loading means against the forming wire on which the web is running. The loading of the loading ribs can be regulated with respect to the deflection of the loading ribs in the transverse direction of the web by means of the pressure provided by a pressure medium, preferably a gaseous pressure medium, to control the retention profile of the web.

The regulation arrangement in accordance with the invention comprises an arrangement for measuring the slice profile of the headbox and passing measurement signals therefrom to a regulation unit. The regulation unit is arranged to control the system so that the deflection of the set of ribs in the transverse direction of the web can be controlled thereby setting the transverse retention profile of the paper web.

By means of the control of the retention profile in accordance with the invention, a profile bar is obtained that is considerably more straight as compared with the prior art devices. In this manner, the transverse flows produced by a strongly profiled profile bar in the pulp web and the unfavorable effects of such flows in the distribution of the fiber orientation are prevented.

In the invention, the transverse retention profile of the web can be controlled preferably by means of existing dewatering and/or forming ribs and by means of their crown-variation means. Specific, separate actuators are not needed for this purpose in the regulation performed by the invention.

The regulation arrangement in accordance with the invention can be favorably integrated in the existing system of regulation of the papermaking process, by whose means the transverse grammage profile of the paper web is measured in the dryer section and the profile of the profile bar of the headbox is adjusted on the basis of this measurement result. The new regulation cycle has a substantially slower time constant than that of the regulation cycle based on the measurement of grammage and described above, so that the regulation arrangement in accordance with the invention neither interferes with the operation of the existing system of regulation nor causes instability in the existing system.

By means of the invention, in paper grades with high contents of fillers, besides a good grammage profile, it is also possible to achieve a good filler profile. The invention can be applied with paper grades not sensitive to orientation so that the arrangement of regulation controls the grammage, and the devices in accordance with the present invention for regulation of the retention profile are used for controlling the filler profile, i.e., the ash content of the web. The latter procedure is particularly suitable for SC grades, in which the filler profile is a quality factor more important than the profile of fiber orientation.

The invention will be described in detail with reference to some preferred embodiments of the invention illustrated in the figures in the drawing. The invention is, however, not confined to these embodiments alone.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
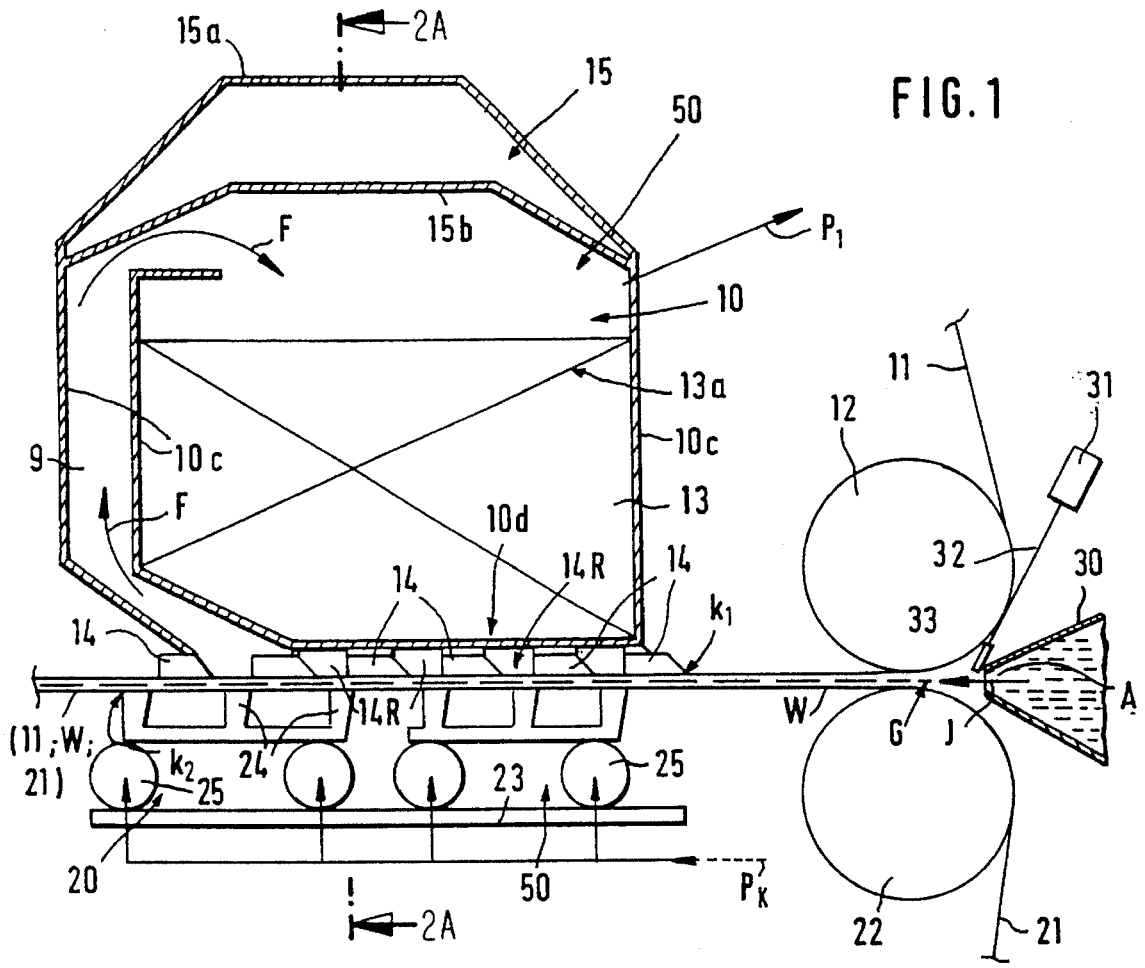
FIG. 1 illustrates the initial part of a forming zone of a twin-wire former in which the method and device in accordance with the invention are applied.

Referring to the drawings, wherein the same reference numerals refer to the same elements, a MB former will be described as a background and as an environment of application of the invention with reference to the schematic illustrations in FIGS. 1 and 2A. FIG. 1 is a highly schematic illustration, out of scale, of a so-called gap former in which a pulp suspension jet J is fed out of a slice A of a headbox 30 into a narrowing gap G formed between a pair of forming wires 11 and 21. The pair of forming wires 11,21 form a twin-wire zone. The geometry of the gap is determined by the position of forming and breast rolls 12 and 22. The forming gap G is followed, directly or after relatively short dewatering and forming members, by an MB unit 50 comprising a box beam 10 arranged inside the loop of an upper one of the wires 11,21 (wire 11 in this case) and in the transverse direction of the machine. Box beam 10 (also referred to as a support beam) is defined by vertical end walls 10*a* and 10*b* placed in the machine direction as well as by transverse vertical walls 10*c* and by a lower wall 10*d*. In its interior, the beam 10 defines a dewatering chamber 13 to which a water drain duct 13*a* is connected, preferably at the driving side of the machine only. In connection with the lower wall 10*d* of the beam 10, fixed support and forming ribs 14 (or loading ribs) are supported. Water is removed out of the web W through gaps 14R between the ribs 14 in the direction of the arrows F through a suction-deflector duct 16 and passed into the chamber 13. From chamber 13, the water flows further through the duct 13*a* to the side of the paper machine. The interior of the chamber 13 communicates with negative pressure $P_1$ by whose means the dewatering of the web is intensified.

Above the beam 10, there is a variation beam 15 of a width and length equal to the width and length of the beam 10. The variation beam 15 is defined at the side 15 facing the beam 10 by a horizontal partition wall 15*b* and from above by a corresponding outer wall 15*a* as well as by an end wall 15*c*. Into the interior of the variation beam 15, through the inlet pipe 17*a* and the valve 16, a flow of a medium having a regulated temperature $T_1$ is passed ($V_{in}$), preferably a water flow, which is removed in a circulation pattern through a pipe 17*b* placed in connection with the opposite end 15*c* of the variation beam 15 in the direction of the arrow $V_{out}$.

Inside the loop of the lower wire 21, there is a loading unit 20 of the MB unit 50. The loading unit 20 comprises a support construction 23 and loading ribs 24 which are arranged in the transverse direction facing the gaps 14R between the support and forming ribs 14. The ribs 24 in the unit 20 are loaded by means of the pressures $P_k$ of the pressure medium passed into loading hoses 25 situated below the ribs. In this manner, the wires 11,21 are pressed between the ribs 14,24 and thereby apply dewatering pressure and rib impulses to the web W to dewater the same. The principal direction of the run of the wires 11,21 and the web W across the sets of ribs 14,24 can be straight or curved with a relatively large curve radius.

The support or box beam 10 is placed at such a location in the twin-wire zone in which the consistency of the web W before the box beam $k_1$ is in the range of from about 1.3% to about 2.5% and the consistency of the web after the box beam $k_2$ is from about 3% to about 5%. By means of the support and forming ribs 14 placed in connection with the box beam 10, it is possible to control the retention profile of the web W so that it is possible substantially to compensate for the increased grammage arising in the dryer section from the shrinkage higher than average of the lateral areas of the web.

Figure 2A:
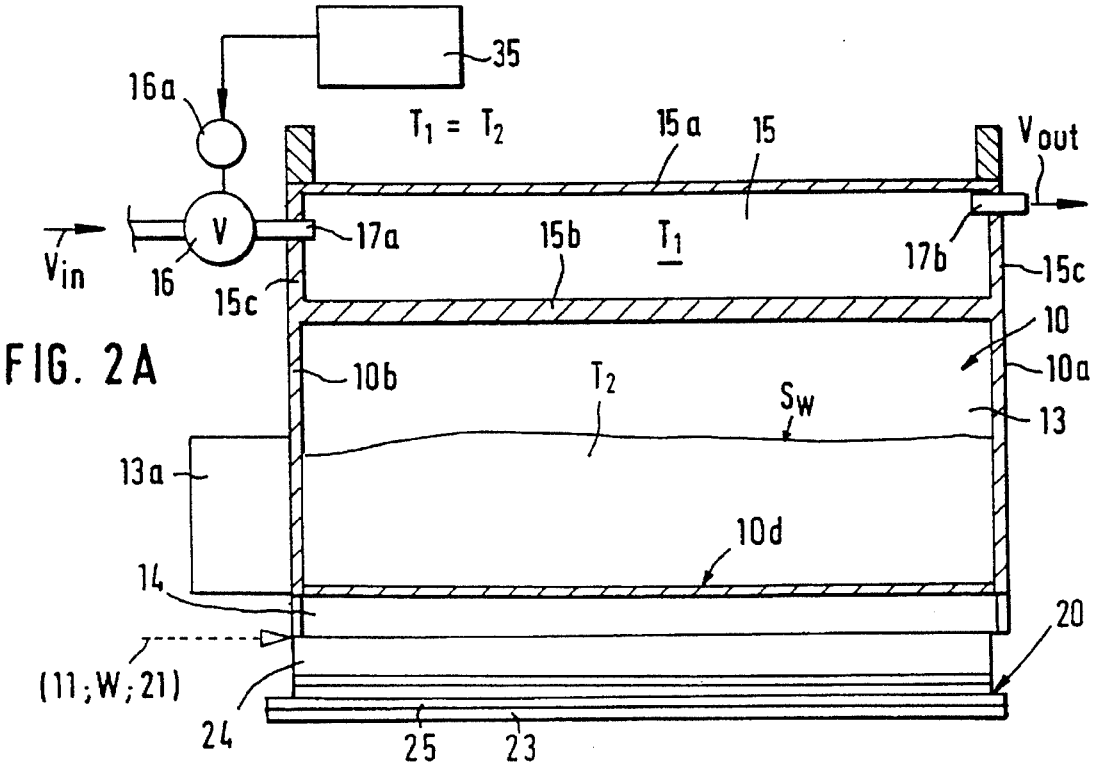
FIG. 2A is a vertical sectional view in the machine direction of a former as shown in FIG. 1 in the plane 2A—2A indicated in FIG. 1 while the deflection of the MB-beam is straight.

As shown in FIG. 2A, the temperature $T_1$ of the water that is fed into the interior of the variation beam 15 is, in the manner known from the prior art, always regulated so that it is substantially equal to the temperature $T_2$ of the water that is removed through the dewatering chamber 13. The surface of the water is denoted by reference $S_w$. In such a case, deflection does not occurs in the walls 15*a*, 15*b*, 10*d* of the beams 10 and 15, and the set of forming and support ribs 14 carried by the wall 10*d* is thus fully straight in the transverse direction, as is shown in FIG. 2A. As is known from the prior art, attempts have been made to provide the loading and support ribs 14 with crown variation by means of the variation beam 15, i.e., the ribs 14 have been "aligned" as straight as possible in order that the wires 11,21 and the web W that is formed between them should pass across the ribs 14,24 through a gap whose width is as uniform as possible in the transverse direction.

A regulation unit 35 is arranged to control a regulator 16*a* of the valve 16 by whose means the arrangement of heating of the variation beam 15 via the flow of heating medium is regulated. In this manner, the deflection of the ribs 14 in the transverse direction of the web can be controlled so as to set the transverse profile of retention of the web.

Figure 2B:
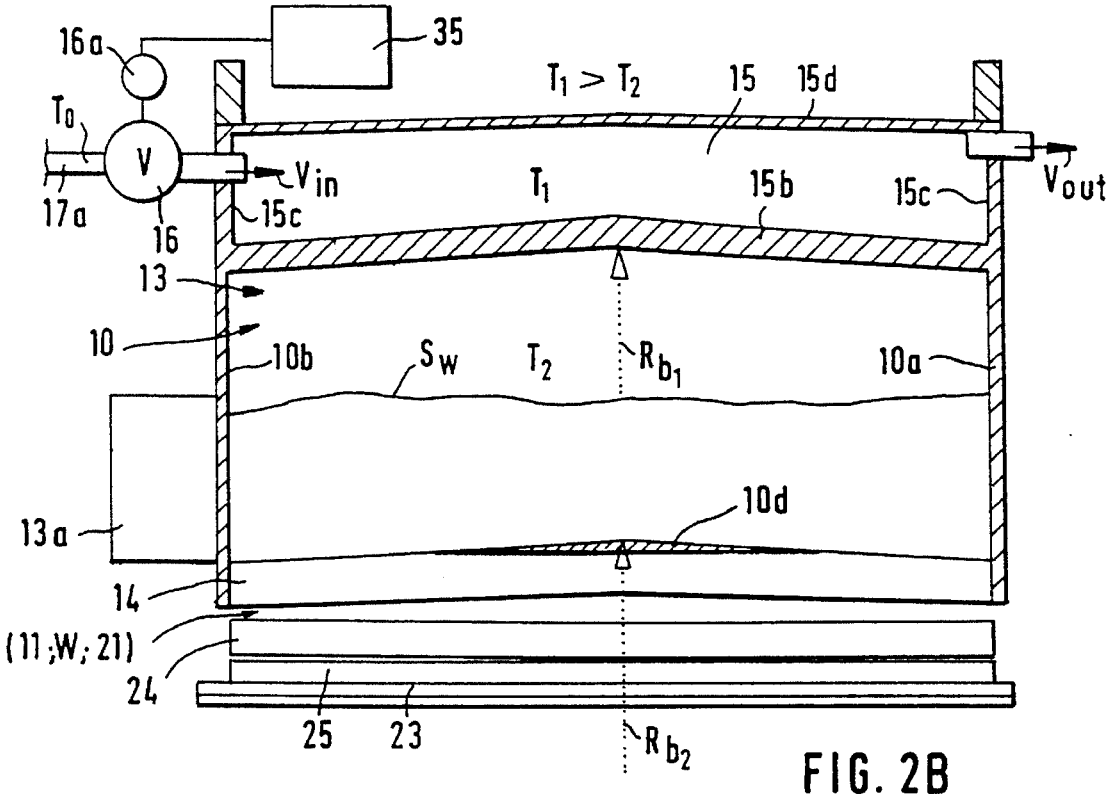
FIG. 2B shows the same as FIG. 2A does, while the MB-beam is deflected upwards in a middle portion thereof.

In the embodiment of FIG. 2B, the temperature $T_1$ of the flow of medium through the variation beam 15 is adjustable so that $T_1>T_2$, wherein $T_2$ is the temperature of the water being constantly removed through the dewatering chamber 13 placed underneath the lower wall 10*d* of the box beam 10. The walls 15*a*, 15*b* and 10*d* of the beams 15,10 are deflected so that, in the transverse vertical plane, the center of curve radii $R_{b1}$,$R_{b2}$ are placed at the side of the lower wire loop 21. In light of this temperature regulation, the dewatering and/or forming ribs 14 placed in connection with the lower wall 10*d* are deflected so that the web W will have a larger gap in its middle area than in its lateral areas and the retention becomes lower than average in the lateral areas of the web.

Figure 2C:
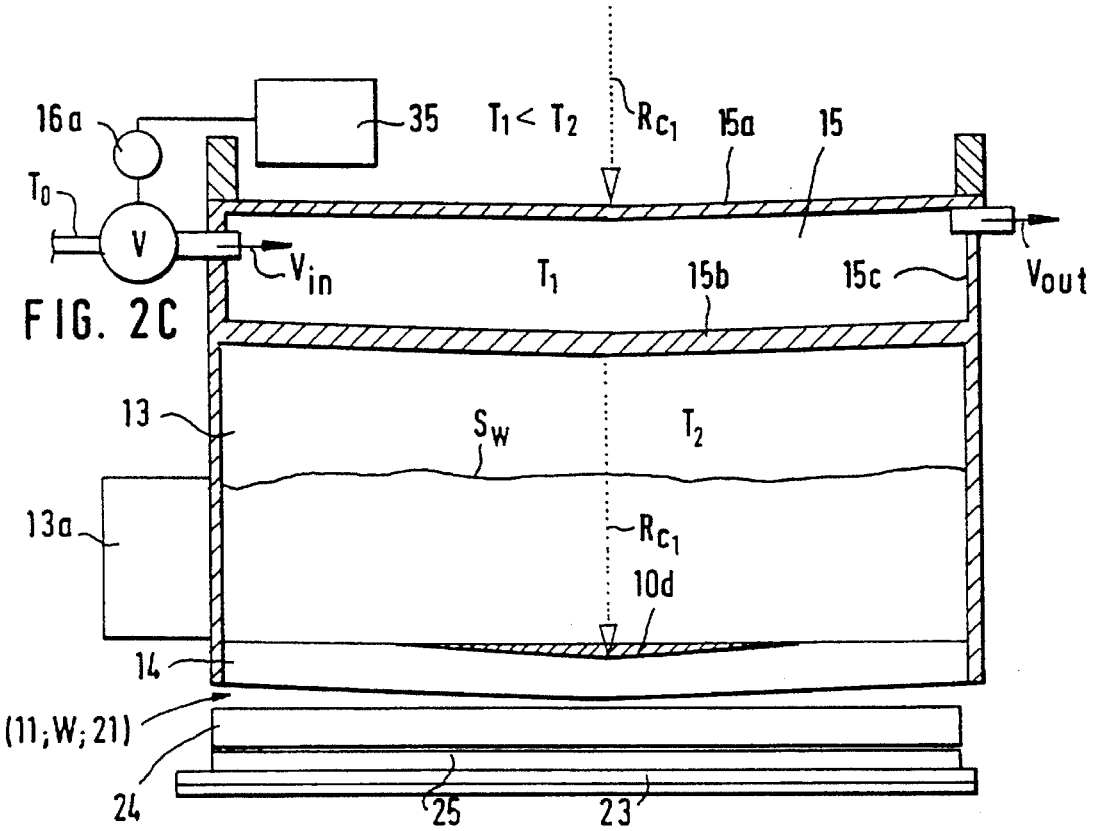
FIG. 2C is an illustration similar to FIGS. 2A and 2B of a situation in which the MB-beam is deflected down in a middle portion thereof.

In the embodiment of FIG. 2C, the temperature $T_1$ of the flow of medium through the variation beam 15 is adjustable so that $T_1<T_2$, wherein $T_2$ is the temperature of the water being constantly removed through the dewatering chamber 13 placed underneath the lower wall 10*d* of the box beam 10. The walls 15*a*, 15*b* and 10*d* of the beams 15,10 are deflected so that, in the transverse vertical plane, the center of curve radii $R_{c1}$,$R_{c2}$ are placed at the side of the upper wire loop 11. For this type of temperature regulation, the dewatering and/or forming ribs 14 placed in connection with the lower wall 10*d* are deflected so that the gap between the ribs 14,24 is smaller in the middle area than in the lateral areas and thus the retention becomes higher than average in the lateral areas of the web.

Thus, as shown in FIGS. 2B and 2C, by regulating the quantity and temperature of the heating medium flowing through the variation beam 15, the variation beam has an adjustable temperature, such that when the temperature of the variation beam 15 is different than the temperature of the water being removed through the dewatering chamber, the lower wall 10*d* of the beam 10 and the set of ribs 14 are deflected and the retention along the width of the web is varied.

Figure 3:
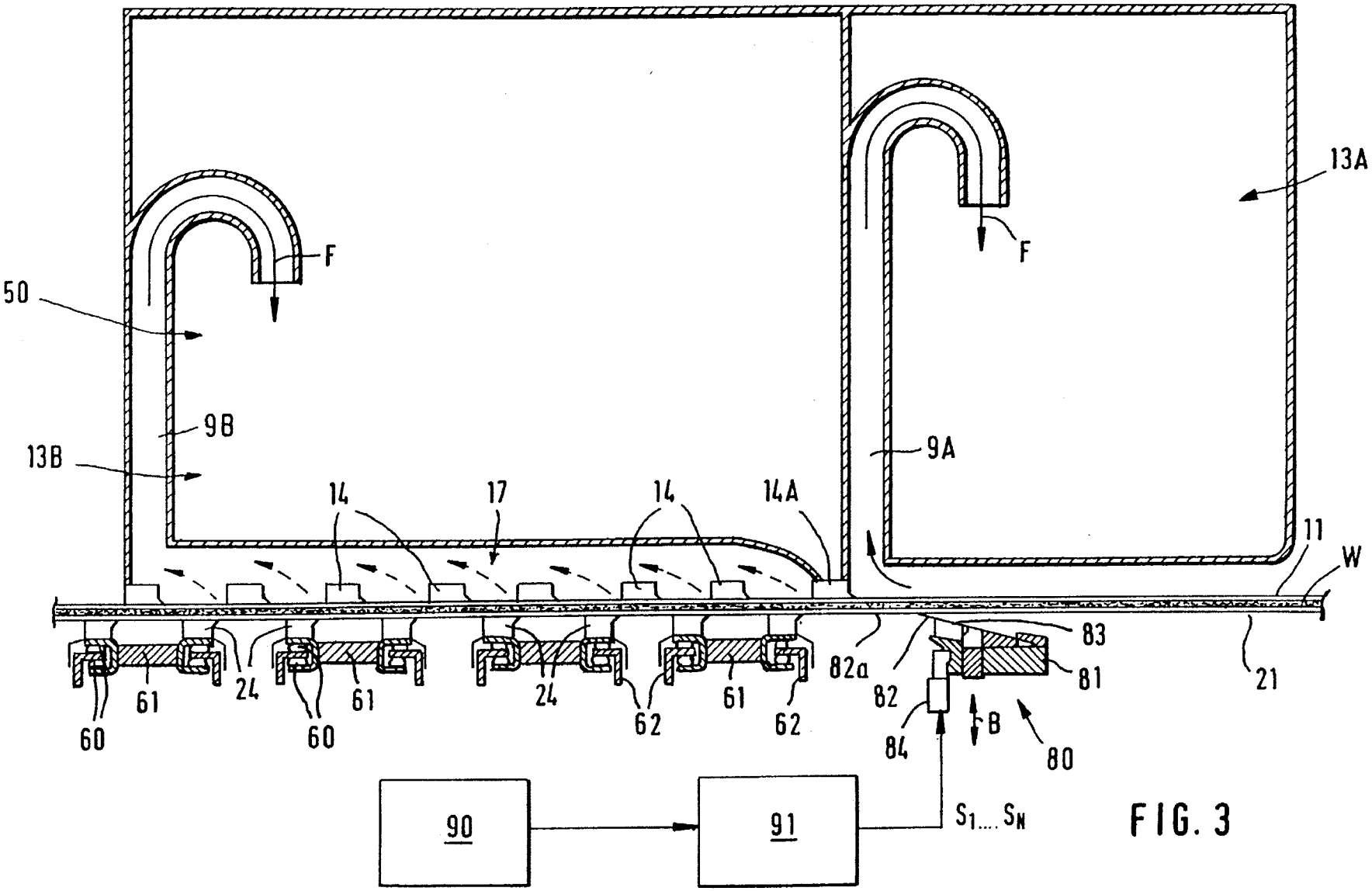
FIG. 3 shows a twin-wire MB zone in which the retention profile is controlled by means of a SYM-PULSE™ device, which can be profiled and which is placed inside the loop of the lower wire.

FIG. 3 shows a MB unit 50 in which there are two successive dewatering chambers 13A,13B. The first dewatering chamber 13A is placed, in the running direction of the wires 11,12 and the web W, before a first fixed upper rib 14A of the set of support and forming ribs 14, which is also preceded by a dewatering duct 16A leading into the first chamber. The first upper rib 14A is followed by a number of fixed ribs 14 whereby water is removed through a duct space 17 above the ribs 14 into another dewatering duct 16B and further, in the direction of the arrow F, into the second dewatering chamber 13B. The negative pressure effective in the chambers 13A and 13B can be separately adjustable to be equal to different. There may also be more than two chambers 13A,13B placed one after the other, for example three or four dewatering chambers, each of which chambers may be provided with an upper and/or lower profile regulation.

As shown in FIG. 3, underneath the latter dewatering chamber 13B, there is a resiliently loaded set of ribs 24 placed facing the gaps between the upper fixed ribs 14. The lower ribs 24 are interconnected, for example in pairs, by means of intermediate parts 61. Instead of one or several sets of ribs 24, it is possible to use one or several SYM-PULSE™ devices, which will be described in more detail later. The loading of the set of ribs 24 is carried out by means of pairs of hoses 60 which are placed at both sides of L-section support parts 62 in a manner in itself known. The pressure of a preferably gaseous medium is passed into hoses 60 so that the loading of the set of ribs 24 is resilient. A SYM-PULSE™ device 80 in itself known is arranged before the set of loading ribs 24 inside the loop of the lower wire 12 and underneath the dewatering duct 16A of the dewatering chamber 13A while facing the dewatering duct 16A. This device comprises a plate-shaped blade member 82 which can be profiled and includes a tip 82*a* placed in the area of the front edge of the first fixed upper rib 14A. The SYM-PULSE™ device 80 also comprises a frame part 81, to which the plate-shaped flexible blade member 82 is attached. The blade member 82 is loaded by means of the pressure of a pressure medium passed into a loading hose 83. The profile of the loading pressure in the area of the tip 82*a* of the blade member 82 against the lower face of the lower wire 12 is regulated by means of a series of regulating spindles 84 in the direction of the arrow B. When the positions of the spindles in the series 84 are regulated by means of regulating signals $S_1, \ldots, S_N$, the series of regulating signals $S_1, \ldots, S_N$ is obtained from a regulation unit 91. Regulation unit 91 is controlled by a measurement unit 90 by means of measurement and set-value signals. To this end, measurement signals of the transverse profile or profiles of the web W are passed into unit 90, e.g., the measurement signals of the retention profile, the fiber-orientation profile, the filler profile, and/or the slice profile.

Figure 4:
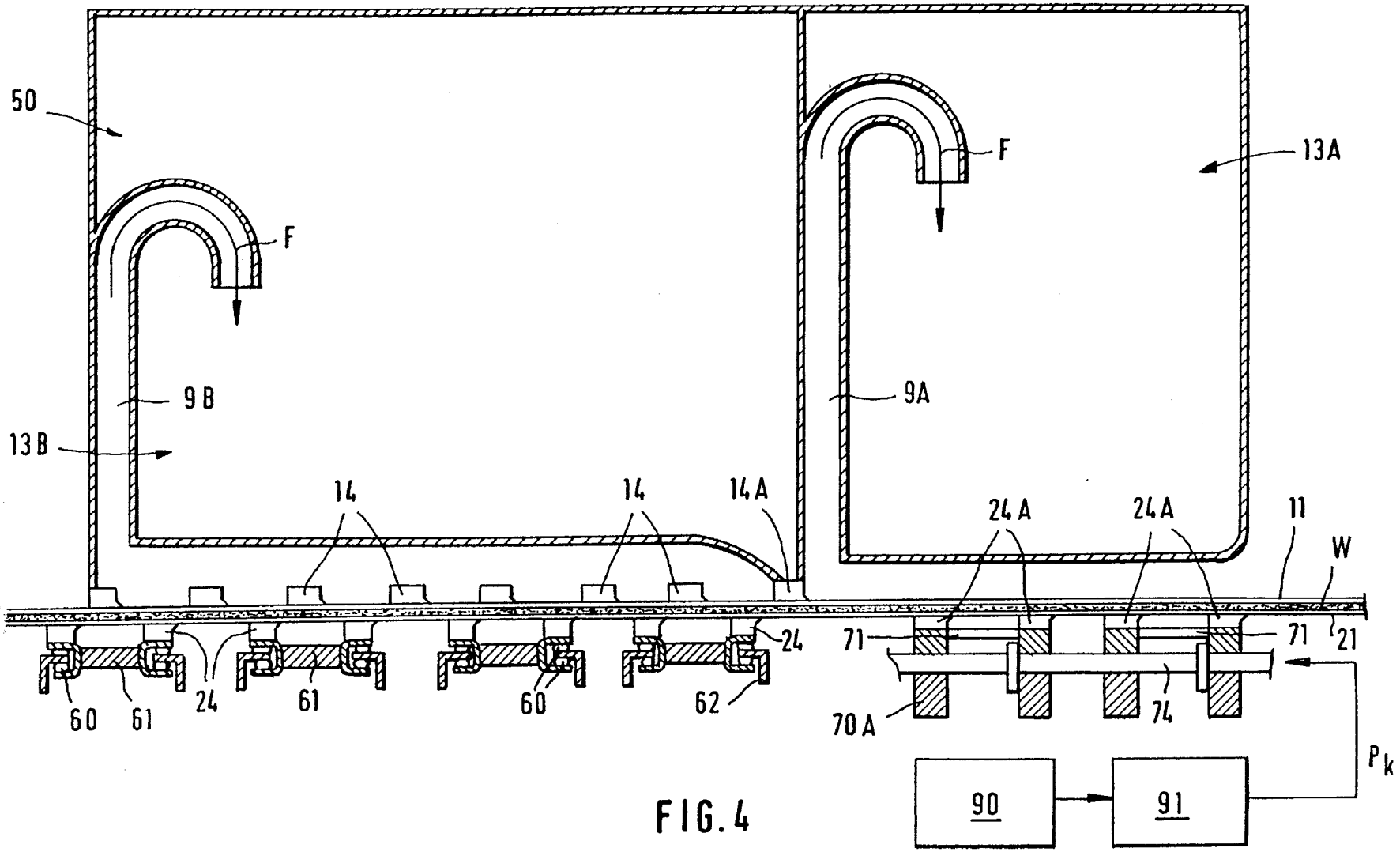
FIG. 4 is an illustration corresponding to FIG. 3 of an embodiment of the invention in which, in the twin-wire zone, before the sets of MB ribs, inside the loop of the lower wire, there is a set of preliminary ribs which are profiled in accordance with the invention.

The MB unit shown in FIG. 4 is in the other respects similar to that shown in FIG. 3 except that the SYM-PULSE™ unit 80 has been substituted for by a profiling unit 70A in which there are two pairs of variable-deflection loading ribs 24A which act upon the lower face of the lower wire 12. The deflection of these ribs 24A is regulated by means of the pressures $P_k$ of a pressure medium passed into the loading hoses 74 in a manner that will be described in more detail later with respect to FIGS. 6A and 6B. The adjustable-deflection ribs 24A are placed underneath the first dewatering chamber 13A. The levels of the pressures $P_k$ of the pressure medium and the mutual ratios of the pressures are regulated by means of regulation signals obtained from the regulation unit 91 controlled by the measurement unit 90. The transverse width of effect of one loading hose 74 placed in the machine direction is selected by changing the vertical rigidity of the loading unit.

Figure 5:
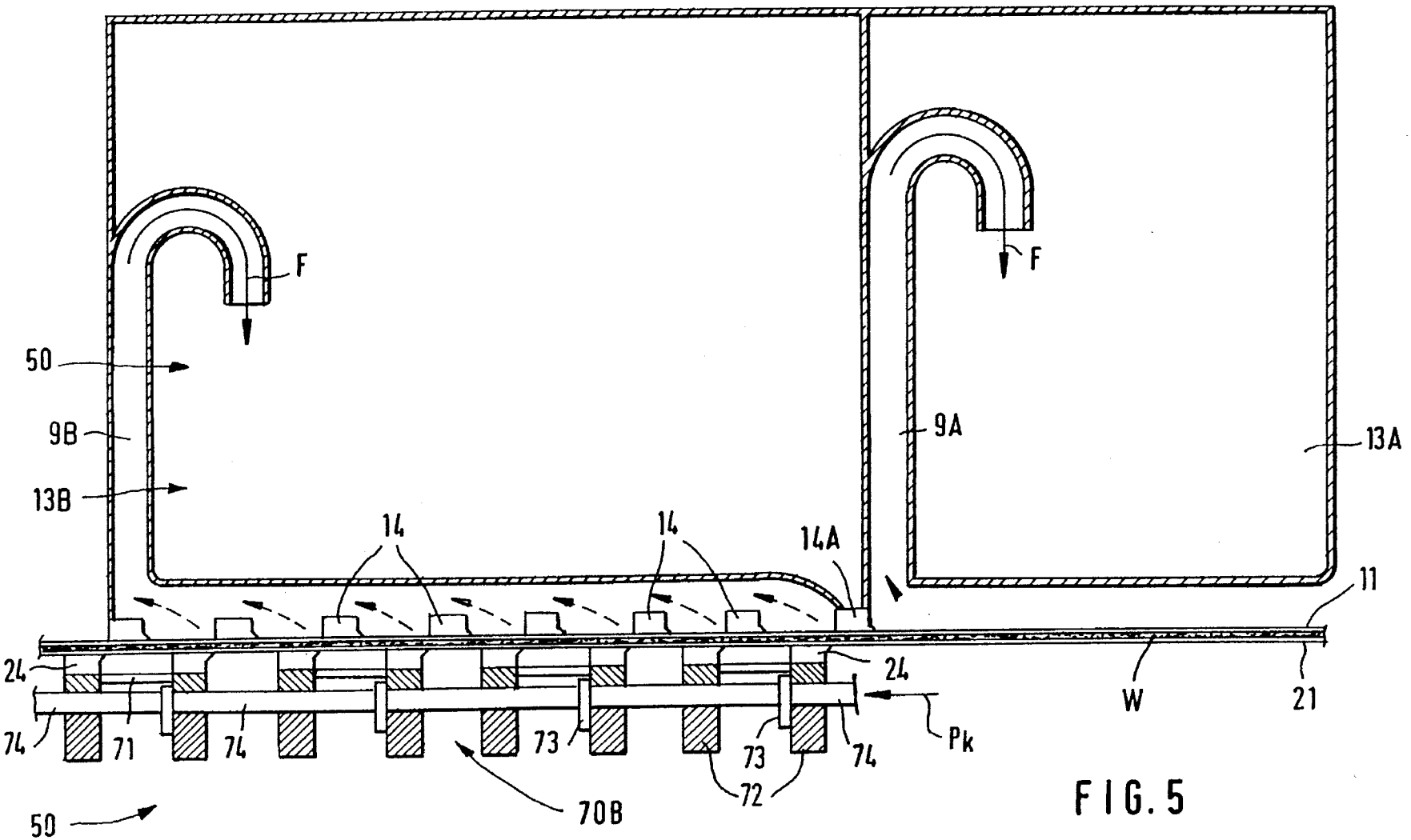
FIG. 5 is an illustration corresponding to FIGS. 3 and 4 of an embodiment of the invention in which, in view of regulation of the retention profile, the set of MB ribs placed inside the lower-wire loop is arranged to be profiled by means of a series of resilient loading hoses placed in the machine direction.

As shown in FIG. 5, a variable-deflection set of ribs 70B is arranged underneath the fixed upper set of ribs 14. Set of ribs 70B is loaded by means of a series of loading hoses 74. The more detailed construction and fitting of the set of ribs 70B is illustrated and described with reference to FIGS. 4, 6A and 6B. The set of ribs 70B comprises several pairs of loading ribs 24 acting upon the lower face of the lower wire 21. Ribs 24 are interconnected in pairs by means of intermediate parts 71. The pairs of ribs 24 are held in position by support parts 73, which are connected with the lower frame parts 72. The support parts 73 support the frame of the ribs 24 from the side of the rear edge, in the running direction of the wires 11,21.

Figure 6A:
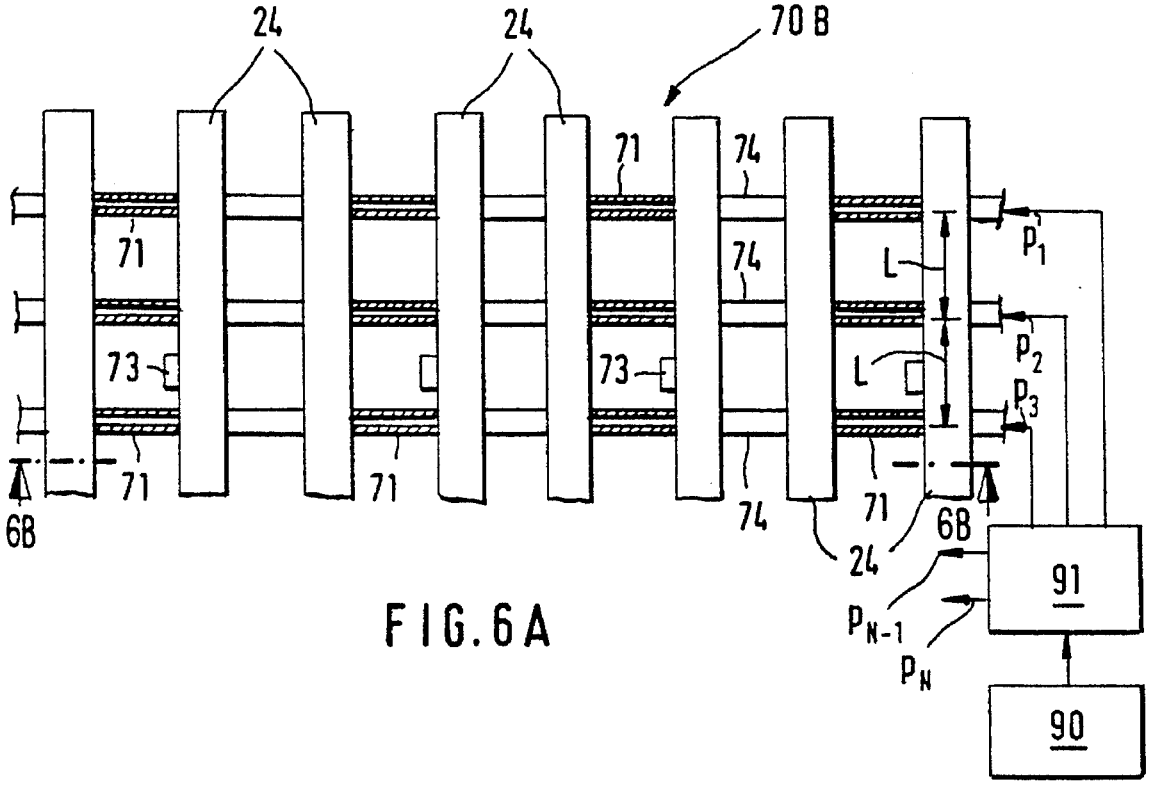
FIG. 6A shows a set of lower ribs that can be profiled, as shown in FIG. 5, viewed from above.
Figure 6B:
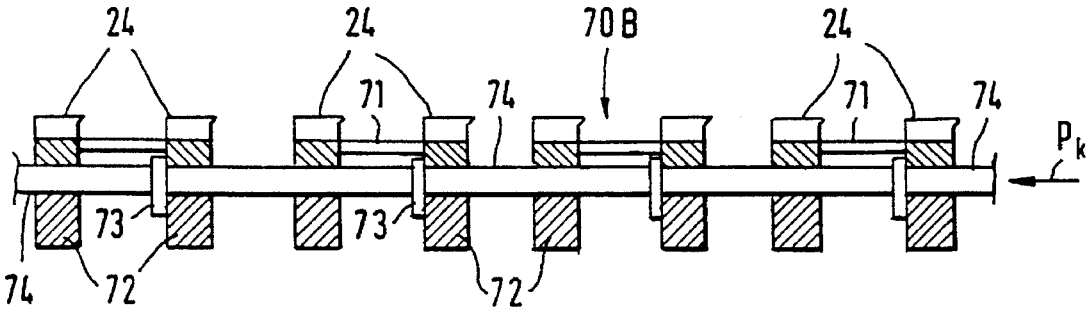
FIG. 6B is a vertical sectional view in the machine direction, taken along the line 6B—6B in FIG. 6A.

FIGS. 6A and 6B illustrate the pairs of ribs 24 resting on a number of elastic loading hoses 74 each being arranged to have a principal direction corresponding to the machine direction but at different transverse locations of the loadings ribs 24. From below, the loading hoses 74 rest on the frame ribs 72, and from above, the loading hoses 74 rest against the lower parts of the frames of the ribs 24. A pressure force $P_1$,$P_2$, $P_3$, . . . , $P_N$, each of which is separately adjustable, is passed, e.g., via a pressure medium, into respective ones of the resilient hoses 74 and is controlled by the regulation unit 91. In this manner, the level of the loading pressure of the ribs 24 against the lower face of the lower wire 21 can be regulated and, at the same time, the loading pressure and the intensities of the formation impulses in the MB zone 14,24 are regulated. When the mutual relationships of the loading pressures $P_1$, . . . ,$P_N$ are regulated separately, the deflection of the ribs 24 in the transverse direction of the web W can be profiled, and thereby the transverse retention profile of the web W can be regulated, whereby a number of advantages that are remarkable in practice can be achieved.

When pressures passing through the elastic hoses 74 are increased in the lateral areas of the ribs 24 in relation to the pressures passing through the hoses 74 in the middle area of the ribs, the lateral areas of the ribs are deflected upward relative to the middle areas. Similarly, when the pressures passing through the elastic hoses in the middle area of the ribs 24 are increased in relation to the pressures passing through the loading hoses in the lateral areas of the ribs 24, the middle area of the ribs 24 are deflected upward relative to the lateral areas of the ribs. There is a number of hoses 74 arranged in the transverse direction of the ribs, denoted by N pcs. The number N is selected as about 30. The more loading hoses 74 that are used in the device, the more precisely the transverse control of the deflection of the ribs 24 be carried out. The transverse distances L between the loading hoses 74 are usually selected in a range from about 50 mm to about 500 mm.

In a further embodiment of the invention, the hoses 74 can be substituted for by separate pressure chambers, whereby a separately adjustable pressure is passed into each of the chambers. Moreover, the chambers may be specific to individual ribs so that the transverse deflection of the each rib can be different. The retention profile is measured directly or indirectly, e.g., on the basis of the grammage profile, the fiber-orientation profile of the web W and/or on the basis of the slice profile of the headbox, which is illustrated schematically in FIG. 6A by the block 90.

Figure 7A:
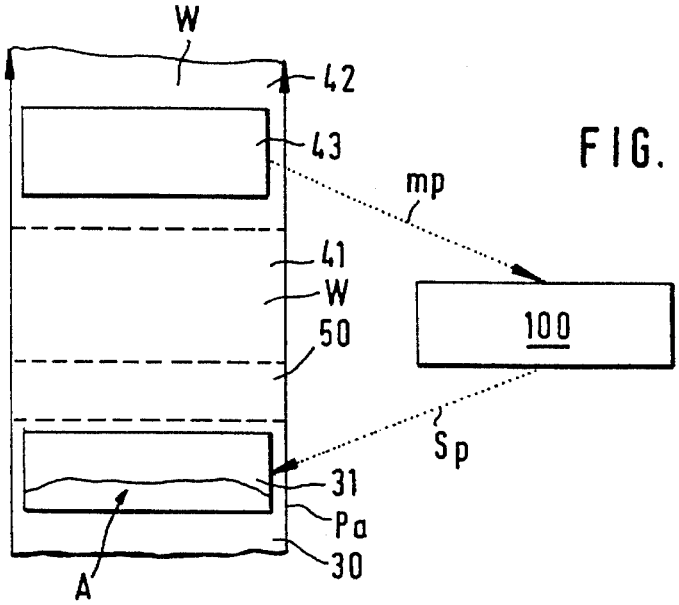
FIG. 7A is a highly schematic illustration of principle of a prior art process-control system of a paper machine which can be used in connection with the method and the device of the present invention.

In the following, with reference to FIG. 7A, a prior art system of regulation of the grammage profile and the fiber-orientation profile in a paper machine will be described as a starting point and as background for the invention. The prior art regulation system will be described in conjunction with FIG. 1 which shows a former to which the regulation system can be applied.

The pulp jet J is fed between the wires 11,21 as shown in FIG. 1 out of the slice A of the headbox 30. After the slice part and the forming gap G, the twin-wire zone passes through the wire part 50 and further to the press section 41. In the wire part 50 and in the press section 41, the web W is dewatered mechanically, after which the web W is transferred to the dryer section 42, where it is evaporation-dried. The profile bar 33 and the slice A are profiled by means of a regulation system which comprises a series of regulation rods 32 attached to the profile bar 33. Rods 32 are regulated by means of a series of actuators 31. The profile regulation means 31,32 receive their regulation signals $S_p$ from a process control system 100. A measurement arrangement for the transverse grammage profile of the web W, which is placed in connection with the dryer section 42, gives a series of measurement signals $m_p$ to the process control system 100. On the basis of measurement signals $m_p$, the process control system 100 controls the profile of the profile bar 33 of the headbox 30 and, at the same time, the transverse profile of the pulp suspension jet J so that, in the finished dried web W, a grammage profile is carried into effect that is as uniform as possible in the cross direction.

During drying, it is a known phenomenon that the web W shrinks in its middle area less than in the lateral areas, the shrinkage being in the middle about 4% and in the lateral areas from about 5% to about 6%. This results in a corresponding increase in the dry solids content in the lateral areas of the web W. The system of regulation shown in FIG. 7A compensates for this increase by regulating the profile of the profile bar 33 such that the width of the flow opening A is smaller in the lateral areas of the web W, which is illustrated by the profile Pa in FIG. 7A. This regulation again results in the distortion of the fiber-orientation profile described above.

As described above, in the prior art, there has always been an attempt to keep the gap between the sets of ribs 14 and 24 in the MB unit 50 as invariable as possible in the transverse direction, in particular in order to keep the retention as even as possible in the cross direction. Retention means the holding of the solid matter in the pulp web W carried between the wires 11,21 and retained by the wires 11,21.

Figure 7B:
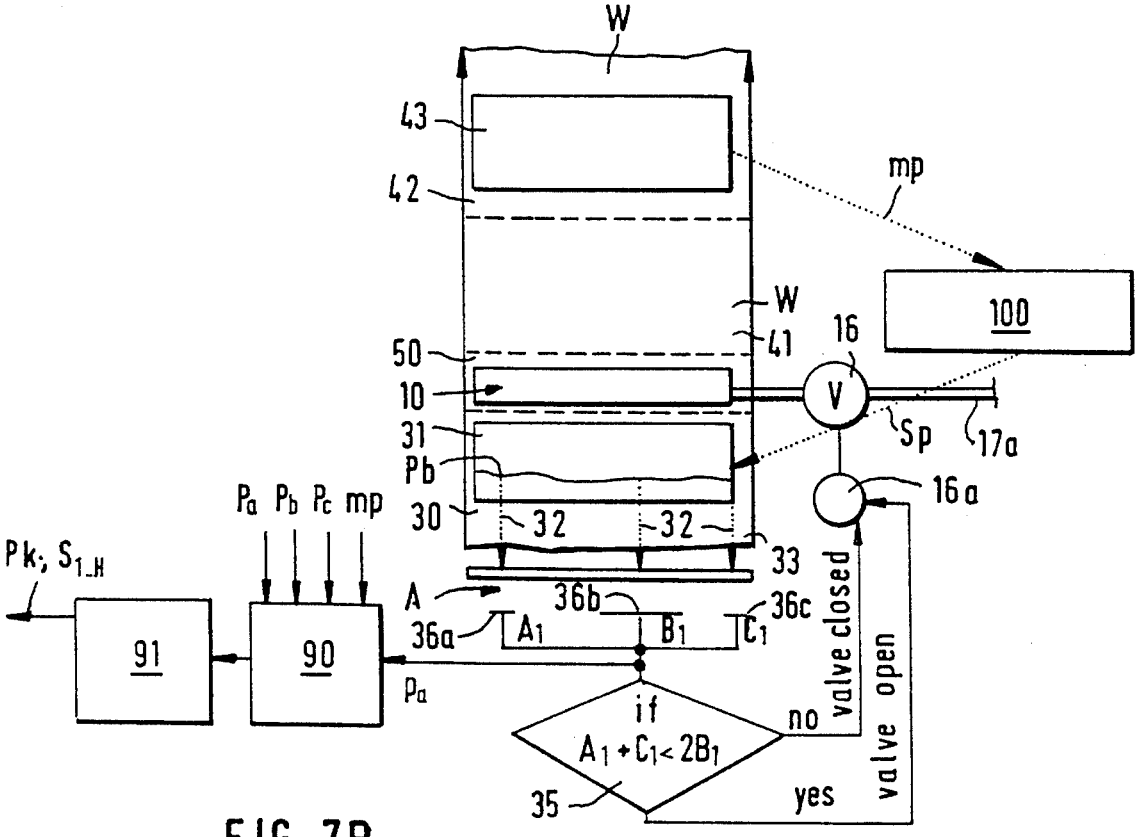
FIG. 7B is an illustration similar to FIG. 7A of a process control system in which the arrangement of regulation that makes use of the method and the device of the present invention has been integrated.

With reference to FIG. 7B, it is an important objective of the invention that, in normal operation, the transverse profile of the slice A of the headbox should always be as uniform as possible. For this purpose, the profile of the slice A is measured in both of its lateral areas by means of detectors 36*a* and 36*c* and in the middle area by means of a detector 36*b*. From the detectors 36*a*, 36*b* and 36*c*, measurement signals $A_1$, $B_1$ and $C_1$, respectively, are received and are passed to a regulation unit 35. Regulation unit 35 regulates an actuator 16*a* of a valve 16 as illustrated in FIG. 7B so that, if $A_1+C_1>2B_1$, the actuator 16*a* regulates the valve 16 to open wider, and if $A_1+C_1<2B_1$, the regulator regulates the valve 16 to a more closed position. The valve 16 may be, for example, a three-way valve, which mixes two waters of different temperatures, or it is possible to use feed water that is at an invariable temperature $T_0$ ($T_0>T_1$), in which case, based on regulation of quantity by means of the valve 16, it is possible to affect the temperature $T_1$ present in the interior of the variation beam 15.

In addition to or, preferably instead of, regulation of the deflection of the variation beam 10, regulation of the deflection of the loading ribs 24A,24 underneath the MB unit 50 is used, for example, so that the transverse profile Pa of the slice A is measured, and the measurement signal Pa thus obtained is passed to the unit 90. In addition to, or instead of, measurement of the slice profile Pa, it is possible to measure the transverse fiber-orientation profile Po, the filler profile Pc or the grammage profile $m_p$. On the basis of any of these measured properties, through the unit 91, the deflection of the lower ribs 24,24A is regulated, controlled by the regulation signals $P_k$,$S_1$, . . . N to control the retention profile of the web W in accordance with the principles given above.

When paper grades are run that are not sensitive to orientation, it is preferable to tune the arrangement of regulation to operate so that the transverse grammage profile of the web is regulated by means of the slice profile Pa, and the filler profile Pc is regulated by the means in accordance with the present invention for regulation of the retention profile. This running mode is particularly suitable for SC grades, in which the filler profile is a quality factor more important than the fiber-orientation profile.

By means of the support and forming ribs 14 placed in connection with the box beam 10, it is possible to control the retention profile of the web W so that the process control system 100 of the papermaking process regulates the profile Pb of the profile bar 33 of the slice A of the slice part of the headbox. Ideally, the profile Pb has a substantially equal width also in respect of the lateral areas of the web W.

The examples provided above are not meant to be exclusive. Many other variations of the present invention would be obvious to those skilled in the art, and are contemplated to be within the scope of the appended claims.

We claim:

1. Method in a paper machine for controlling a transverse profile of at least one property of a paper web, wherein the web is carried between two forming wires and dewatered under compression by dewatering ribs and/or forming ribs, the paper machine having a machine direction, comprising the steps of:

arranging a first group of said ribs in a loop of a first one of said forming wires, each of said ribs in said first group extending in a direction transverse to the machine direction, deflecting at least two ribs in said first group of ribs in the transverse direction, said deflecting step comprising the steps of arranging a plurality of elastic hoses each at a different location in the transverse direction in a position extending substantially in the machine direction between said at least two ribs, and directing pressure media through said hoses, and regulating the deflection of said at least two ribs by independently regulating the pressure of the pressure medium being directed through each of said hoses to control the transverse retention profile of the web to thereby influence the transverse fiber-orientation profile and/or the filler profile of the paper web.

2. The method of claim 1, further comprising the steps of:

arranging a second group of said ribs in a loop of a second one of said forming wires opposite from said first group of ribs, deflecting said ribs in said second group of ribs, and regulating the deflection of ribs in said second group of ribs to regulate the pressure load between ribs in said first and second groups of ribs.

3. The method of claim 1, further comprising the steps of:

arranging a second group of said ribs in a loop of a second one of said forming wires opposite from said first group of ribs to define an MB zone through which the web runs, passing the web over a profiling unit constituting ribs situated in advance of said MB zone in the machine direction, deflecting said ribs in said profiling unit in a transverse direction of said ribs, and regulating the transverse deflection of said ribs in said profiling unit.

4. The method of claim 1, further comprising the steps of:

measuring a transverse property profile of the web, and regulating the deflection of said at least two ribs relative to the measured transverse property profile.

5. The method of claim 1, further comprising the steps of:

directing a pulp flow from a slice of a headbox to form the web, and controlling the transverse profile of the slice of the headbox relative to the transverse retention profile such that the transverse profile of the slice has a substantially equal width to thereby prevent the occurrence of a transverse pulp flow velocity.

6. The method of claim 5, further comprising the steps of:

measuring the width of the slice of the headbox in a middle area and in lateral areas in a transverse direction of the slice of the headbox, and regulating the deflection of said first group of said ribs based on the measurement of the width of the slice of the headbox.

7. The method of claim 5, further comprising the steps of:

measuring the transverse grammage profile of the web after it has been dried, profiling the pulp flow from said slice of said headbox by means of a profile bar, regulating the profile of said profile bar on the basis of the measurement of the transverse grammage profile of the dried web, deflecting said at least two ribs to lower the retention level in lateral areas of the web relative to an average retention level and to compensate for the increased grammage arising from the shrinkage higher than average in the lateral areas of the web upon drying of the web.

8. The method of claim 1, wherein said forming wires define a twin-wire zone, further comprising the steps of:

arranging a second set of said ribs opposite said first set of ribs in a loop of a second one of said forming wires, said first set of ribs pressing said forming wires and the web against said second set of ribs, guiding said forming wires and the web carried thereon between said first and second sets of ribs in an initial part of said twin-wire zone where the consistency of the web is in a range from about 1.3% to about 5%, arranging a support beam in the transverse direction to the machine direction of said twin-wire zone, said second set of ribs being fixedly attached to said support beam, and adjusting the deflection of said support beam to adjustably deflect said second set of ribs and thereby influence the transverse retention profile.

9. The method of claim 8, wherein said twin-wire zone is horizontal and said second forming wire runs above the web, said support beam is arranged in a loop of said second forming wire, further comprising the steps of:

arranging a variation beam above said support beam, and heating said variation beam to regulate its transverse deflection.

10. The method of claim 9, wherein said second set of ribs is attached to a lower wall of said support beam, said variation beam comprising a dewatering chamber in an interior thereof through which a heating medium is passed, further comprising the steps of:

spacing individual ribs in said second set of ribs to define gaps therebetween, guiding water removed from the web through said gaps and a suction-deflector duct into said dewatering chamber and removing the water therefrom, and regulating the quantity and temperature of the heating medium to provide said variation beam with an adjustable temperature, such that when the temperature of the heating medium flowing through said variation beam is different than the temperature of the water being removed through said dewatering chamber, said lower wall of said beam and said second set of ribs are deflected and the retention along the width of the web is varied.

11. The method of claim 1, further comprising the step of deflecting one portion of each of said at least two ribs with respect to another portion of a respective one of said at least two ribs.

12. The method of claim 1, further comprising the step of fixedly connecting said at least two ribs to each other.

13. The method of claim 1, further comprising the step of spacing said hoses from one another a distance between 50 mm and 500 mm.

14. A device in a paper machine for controlling at least one transverse profile of properties of a paper web, the paper machine having a machine direction and forming wires which define a twin-wire zone, comprising a first set of loading ribs arranged in said twin-wire zone in a loop of a first one of the forming wires, a second set of dewatering ribs and/or forming ribs positioned facing said loading ribs in a loop of a second one of the forming wires, loading and deflecting means for loading said loading ribs against the first forming wire and for deflecting said loading ribs in a transverse direction thereof, said loading and deflecting means comprising elastic hoses each arranged at a different location in the transverse direction in a position extending substantially in the machine direction between at least two of said loading ribs, said loading and deflecting means directing pressure media through said elastic hoses, and regulating means for regulating the deflection of said at least two loading ribs by independently regulating the pressure of the pressure medium being directed through each of said elastic hoses to control the retention profile of the web.

15. The device of claim 14, further comprising a stationary frame part for supporting said elastic hoses, said elastic hoses pressing against said stationary frame part during loading to thereby load said loading ribs against the first forming wire, said regulating means providing adjustable levels and mutual ratios of pressure medium through said elastic hoses to regulate the transverse deflection of said loading ribs.

16. The device of claim 14, further comprising means defining at least one dewatering chamber inside a loop of the second forming wire in said twin-wire zone, said chamber having a dewatering duct, said second set of dewatering ribs and/or forming ribs being fixed inside said loop of said second wire and defining gaps between ribs therein through which water is removed from the web through said second wire, means for passing the water removed through said gaps to said at least one dewatering chamber, and intermediate parts for interconnecting pairs of said loading ribs, said loading ribs being arranged on support of said hoses, the loading pressure and transverse deflection of said loading ribs being controlled by pressure of the pressure medium passing into said hoses.

17. The device of claim 14, further comprising a profiling unit arranged before said loading ribs in the machine direction, said profiling unit comprising a set of preloading ribs.

18. The device of claim 14, further comprising connecting means for fixedly connecting said at least two ribs to each other.

19. A regulation arrangement in a paper machine for controlling a transverse profile of at least one property of a paper web produced in the paper machine, the paper machine including a wire part having a twin-wire zone in which first and second sets of ribs are placed opposite each other, and a measurement arrangement for measuring the grammage profile of the paper web arranged in connection with, or after, a dryer section of the paper machine, said measurement arrangement providing a measurement signal to a process control unit, said process control unit providing a regulation signal to profiling means for adjusting a profile bar of a slice of a headbox in the paper machine, comprising means for transversely deflecting said first set of ribs, said deflecting means comprising elastic hoses each arranged at a different location in the transverse direction in a position extending substantially in the machine direction between at least two of said loading ribs, said deflecting means directing pressure media through said elastic hoses, measurement means for measuring the transverse profile of the slice of the headbox and generating measurement signals based thereon, and a regulation unit for receiving said measurement signals and controlling the transverse deflection of said first set of ribs by independently regulating the pressure of the pressure medium being directed through each of said elastic hoses to set the transverse retention profile of the paper web based upon said measurement signals.

20. The arrangement of claim 19, further comprising connecting means for fixedly connecting said at least two ribs to each other.

21. The arrangement of claim 19, wherein said measurement means comprise at least one measurement detector arranged in a middle area of the web in connection with the slice of the headbox, and a measurement detector arranged in each lateral area of the web on both sides of said middle areas in connection with the slice of the headbox, said measurement detectors being passed to said regulation unit.

22. The arrangement of claim 19, wherein the retention profile of the web is controlled by the regulated deflection of said first set of ribs to compensate for increased grammage arising in the dryer section from web shrinkage higher than average in lateral areas of the web and such that the profile of the profile bar of the slice of the headbox has a substantially equal width.

23. The arrangement of claim 19, wherein said regulation unit is integrated with said wire part such that the time constant of said wire part with said regulation unit integrated thereto is substantially larger than the time constant of said wire part without said regulation unit.

24. The arrangement of claim 19, wherein the transverse grammage profile of the paper web is regulated primarily on the basis of the regulation of the slice profile of the headbox, and the transverse filler profile of the web is controlled by regulating the retention profile.

25. A device for controlling a transverse profile of a property of a paper web in a twin-wire forming section in which the web is carried between a pair of wires, the paper machine having a machine direction, comprising at least two ribs situated adjacent one of said wires, and means for loading said at least two ribs against the adjacent forming wire and for deflecting said at least two ribs in a direction transverse to the machine direction to control the transverse profile of the web, said loading and deflecting means comprising elastic hoses each arranged at a different location in the transverse direction in a position extending substantially in the machine direction between at least two of said loading ribs, said loading and deflecting means directing pressure media through said elastic hoses.

26. The device of claim 25, further comprising connecting means for fixedly connecting said at least two ribs to each other.

27. The device of claim 25, wherein said device is arranged in a web former having an MB unit, said MB unit including two sets of dewatering ribs and/or forming ribs which operate against each other, at least one of said two sets of ribs being loaded against the opposite set of ribs, said at least two ribs being situated in advance of said MB unit in the machine direction.

* * * * *